US005801675A

United States Patent [19]

Paley et al.

[11] Patent Number: 5,801,675

[45] Date of Patent: Sep. 1, 1998

[54] PROCESS FOR SCROLLING A PLURALITY OF RASTER LINES IN A WINDOW OF A PERSONAL COMPUTER DISPLAY SCREEN RUN IN GRAPHIC MODE

[75] Inventors: Greg Paley, Mountain View, Calif.; Wulf Bauer, Cologne, Germany

[73] Assignees: Vobis Microcomputer AG; Award Software Int. Inc., both of Wurselen, Germany

[21] Appl. No.: 537,801

[22] PCT Filed: Feb. 17, 1995

[86] PCT No.: PCT/DE95/00205

§ 371 Date: Jan. 18, 1996

§ 102(e) Date: Jan. 18, 1996

[87] PCT Pub. No.: WO95/22814

PCT Pub. Date: Aug. 24, 1995

[30] Foreign Application Priority Data

Feb. 21, 1994 [DE] Germany ..... 44 05 330.4

[51] Int. Cl.[6] ..... G09G 5/34

[52] U.S. Cl. ..... 345/123; 345/125

[58] Field of Search ..... 345/25, 26, 115, 345/123–125, 340, 341

[56] References Cited

U.S. PATENT DOCUMENTS

| | | | |
|---|---|---|---|
| 4,435,703 | 3/1984 | Hunt et al. | 345/25 |
| 4,437,093 | 3/1984 | Bradley | 345/125 |
| 4,611,202 | 9/1986 | DiNitto et al. | 345/123 |
| 4,706,075 | 11/1987 | Hattori et al. | 345/115 |
| 4,816,817 | 3/1989 | Herrington | 345/198 |
| 4,873,514 | 10/1989 | Nakagawa et al. | 345/26 |
| 5,053,761 | 10/1991 | Webster, III | 345/123 |

*Primary Examiner*—Steven J. Saras
*Assistant Examiner*—Xu-Ming Wu
*Attorney, Agent, or Firm*—John Lezdey

[57] ABSTRACT

The invention relates to a procedure for scrolling some raster scan lines in a window of a screen operated in the graphic-mode of a personal computer. The computer has a processor and a program memory allocated to it as well as a video card connected to the processor via an external bus. The video card has a video memory (RAM), whose memory contents can be presented on the screen. One first line of the raster scan lines to be scrolled, is moved into a raster scan line within the window and is marked with a source-pointer. The raster scan line within a window, in which this line is to be moved into, is marked with a destination pointer. Afterwards, a scroll is performed and repeated until all lines to be scrolled are in raster scan lines of the window. At the same time with the first line, the subsequent third line is also at least scrolled in raster scan lines of the screen window. Afterwards, the second line and the fourth line of some raster scan lines to be scrolled are scrolled from lines in raster scan lines of the screen window and so on until all lines to be scrolled are scrolled in raster scan lines of the window.

5 Claims, 2 Drawing Sheets

PROCESS FOR SCROLLING A PLURALITY OF RASTER LINES IN A WINDOW OF A PERSONAL COMPUTER DISPLAY SCREEN RUN IN GRAPHIC MODE

BACKGROUND OF THE INVENTION

1. Field of the Invention

The invention relates to a procedure for scrolling of some raster-lines in a window of a screen, operated in the graphic-mode, of a personal computer, which has a processor and a program memory allocated to it as well as a video card, connected with the processor via an external bus, such video card having a video memory (RAM), whose memory contents can be presented on the screen, where one first line of the raster scan lines to be scrolled, to be moved in a raster scan line within the window, is marked with a source-pointer and such raster scan line within a window, in which this line is to be moved into, is marked with a destination pointer, after that a scroll is performed and repeated until all lines to be scrolled are in the raster scan lines of the window.

2. Description of the Prior Art

The scrolling is performed, to scroll the information contained in certain lines to another determined position, meaning to certain other raster scan lines of the window on the screen. These lines can be already displayed raster-lines, which are at another position within the window, they can also be lines especially, which are not presented on the screen of the window yet, but are i.e. on another text page.

A procedure of the above-mentioned kind is known from the European patent 71 725. With the procedure known the line having the source-pointer is moved in the raster-line, which is marked with the destination pointer, positioned in the window. After that the following line is moved in the following raster-line and so on until all lines, which need to be scrolled, were moved (scrolled) in raster-lines of the window.

With the procedure known the processing-speed and the transfer-width, which computers offer, equipped with modern processors of type x386 and higher, are not fully used on one hand, on the other the image structure in the window is performed relatively sharp, because line after line is moved and added. A relatively keen-edged transition is produced. Attention has to be paid to the fact that with a scrolling procedure as mentioned above and known from the stated printed patent specification, the scrolling, meaning the movement of individual raster-lines, does not occur synchronically to the line frequency of the screen, whereby during the actual transfer procedure unwanted images are produced on the screen, mostly a flickering and snow. In the stated printed patent specification it is already suggested in a preferred embodiment not to present the environment in which the movement during the transfer procedure (scrolling) is produced, just leaving it black or fill it up with a colour on purpose. As soon as the scroll-procedure is finished this blanking or the filling with a colour attribute is stopped and the raster-lines are presented.

It is the object of the invention to more fully use the possibilities of modern processors of mentioned type, meaning x386 and higher, than before and speed-up the scrolling process accordingly, project it, however otherwise that the transition between already scrolled raster-lines and raster-lines not yet scrolled are presented more smoothly, so that sharper contrast differences do not occur.

SUMMARY OF THE INVENTION

The object is solved according to the invention, by the fact that at the same time with the first line also at least the subsequent third line is scrolled in corresponding raster-lines of the screen window, that after that the second and at least the fourth line of the area to be scrolled is scrolled from lines in raster-lines of the screen window and so on until all lines to be scrolled were scrolled in raster-lines of the window.

According to the invention the scrollings are performed with the maximum capacity the processor has to offer. With the mentioned processors of type x386 and higher, two word-scrollings are performed. Altogether always two uneven-numbered or two even-numbered lines are scrolled at least, preferably four or more. By that the number of scrollings per clock is at least double as according to the state of art, the scroll-procedure is performed faster accordingly. By the simultaneous scrolling of many even-numbered lines or uneven-numbered lines the image structure in the window of the screen occurs shifted, initially the scrolled even-numbered lines are displayed between which the uneven-numbered raster-lines remain empty. Afterwards in a second scrolling-step these uneven-numbered raster numbers are also filled and so on. For a user the image structure is more pleasant because of this and for the eye it is more relaxing. This is therefore sufficient, because the image structure as such occurs faster. The two advantages gained with the invention are therefore closely connected with each other.

In a preferred embodiment for even-numbered lines at least four even-numbered lines are scrolled in raster-lines of the window per scrolling step and in a subsequent scrolling-step at least four odd-numbered lines are scrolled in raster-lines of the window. By this the image structure is performed much faster, the line-shift is kept with the image structure and is marked even more explicitly.

In a further improvement the scroll-movements, meaning the movement in the video memory, are performed in double-word steps. The full capacity of the processor is used here. It is possible to transfer the information in 32 bit. With an edge condition an individual treatment of the bytes occurs or i.e. words in such a way that the two-word limitation is being kept.

By the term screen we mean a so-called cathode ray tube, with which at least one electron-beam is lead, screened line-shaped over an image wall, covered with phosphorescent material.

The invention is explained further with regard to the drawing, in which a non-limiting embodiment is illustrated. This is explained further with regard to the drawing in the following. This relates to a scrolling in the CGA-compatible video modes 4,5, and 6 and is explained further according to the drawing. The description can be transferred to other modes. The drawing shows in:

BRIEF DESCRIPTION OF THE PREFERRED DRAWINGS

FIG. 1: a flow chart for the run of the automatic-test (POST-test) of a personal computer, running after the start FIG. 2: a flow chart for the run of a scrolling and FIG. 3: a flow chart for the sub-program used in FIG. 2 at two positions.

DESCRIPTION OF THE PREFERRED EMBODIMENTS

Figure 1:
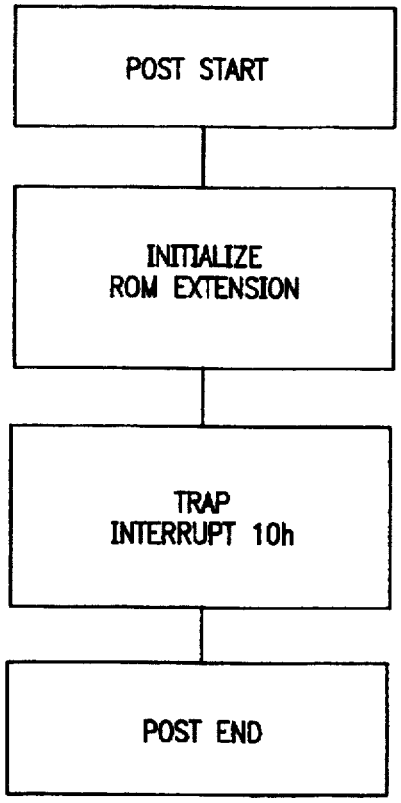

FIG. 1 shows the program run as it runs with the initial test the so-called POST, the abbreviation for power on self test. When switching on the computer, meaning with "start", several tests are being executed which relate to the central hardware of the personal computer, i.e. processor, memory, interrupt-controller, DMA etc. Also ROM-extensions are tested, which are either positioned on the motherboard or on the extension-card and which have the task to extend or replace the functions of the BIOS. Such extensions can be recognised by the first two byte in the memory environment which is allocated by them.

The ROM-module is used now for re-directing the interrupt-vector 10 h on its own routine. By this the normal function of the BIOS is replaced by a new function. The POST-test ends with a POST END. After that the interrupt 10h is called in the normal manner.

For the code to be explained hereinafter the following parameter are used:

[BP+5] number of the function

[BP−2] source-pointer in even-numbered raster-line of the video-memory

[BP−4] destination pointer in even-numbered raster-line

[BP−5] number of bytes to be copied per raster-line

[BP−8] number of raster-line pairs to be scrolled

The code runs as follows:

1. Call of sub-routine 4.
2. Add 2000 h to [BP−2] and [BP−4].
3. Call of sub-routine 4.
4. Deduct 2000 h from [BP−2] as well as from [BP−4].
4. Repeat ([BP−8]/2)+1 times a. CX=zero-expanded [BP−5]

b. SI=[BP−2], DI=[BP−4]

c. Move CX right by one, if carry, then movsb d. Move CX to right by one, if carry, then movsw e. Execute of rep movsd f. If [BP+5]=6,[BP−2]+=80,[BP−4]+=80;

and further [BP−2]−=80, [BP−4]−=80.

Figure 2:
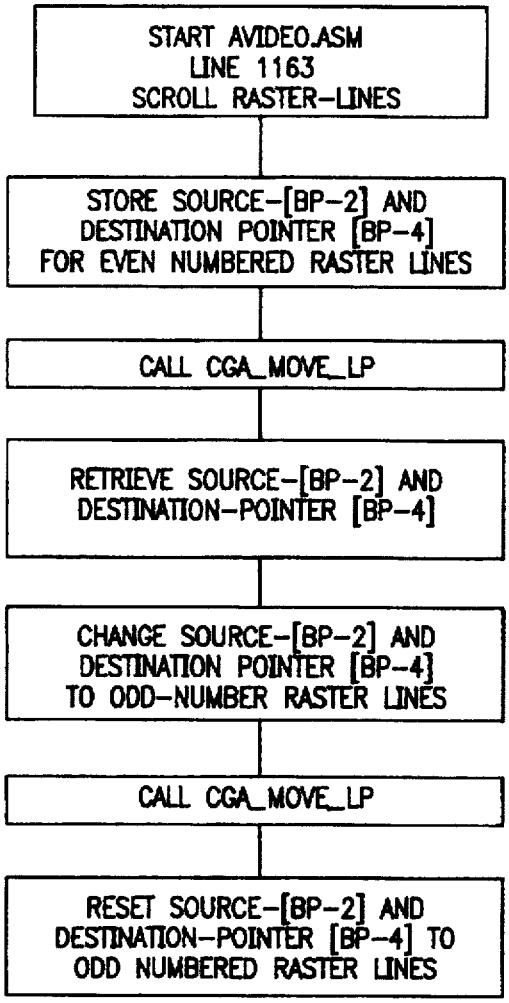
Figure 3:
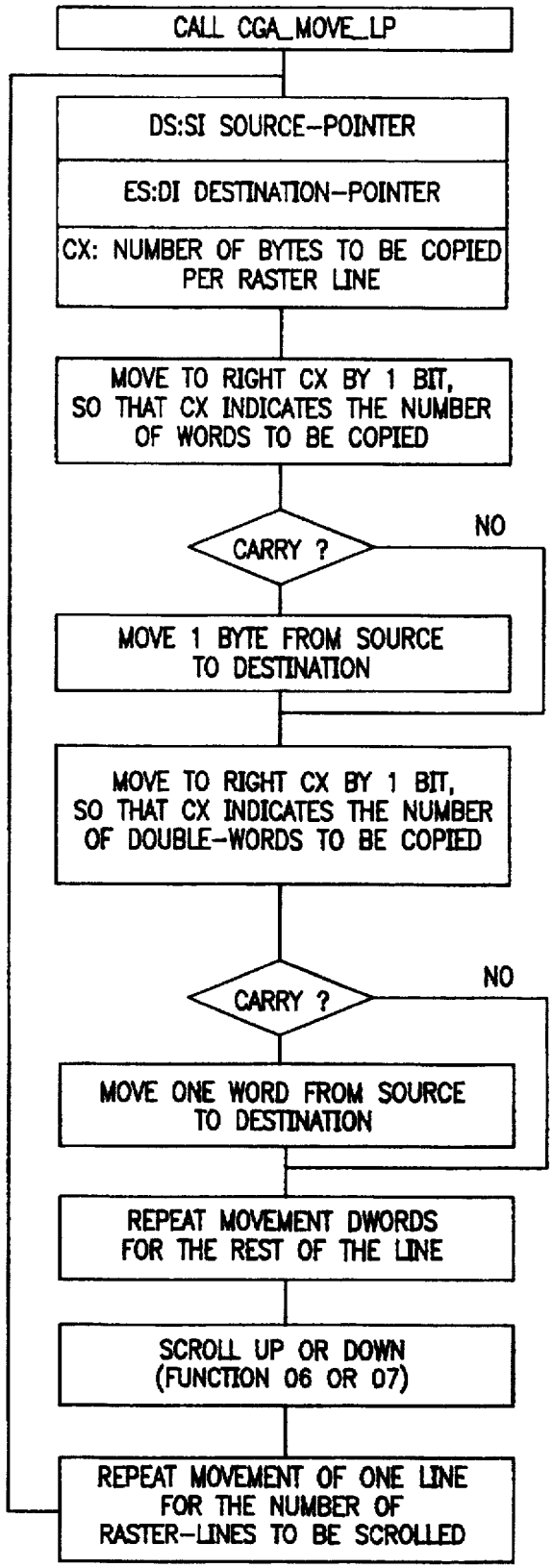

The run of a scanning procedure can be seen from FIGS. 2 and 3. After the run according to FIG. 2 at least two even-numbered and after that at least two odd-numbered raster scan lines are scrolled from the source-pointer to the destination pointer Hereby the sub-program CGA_MOVE_LP is called twice, which can be seen from FIG. 3. From the run demonstrated there, it can be seen, that when scrolling the maximum capacity, which the processor offers, is always used. The scrolling preferably occurs in double-words.

We claim:

1. Procedure for scrolling of some raster scan lines in a window of a screen, operated in the graphic-mode, of a personal computer, which has a processor and a program memory allocated to it as well as a video card, connected with the processor via an external bus, said video card having a video memory (RAM), whose memory contents can be displayed on the screen, where one first line of the raster scan lines to be scrolled, to be moved in a raster scan line within the window, is marked with a source-pointer and such raster scan line within a window, in which this line is to be moved into, is marked with a destination pointer, after that a scroll is performed and repeated until all lines to be scrolled are in the raster scan lines of the window, characterized by the fact that at the same time with the first line also at least the subsequent third line is scrolled in raster scan lines of the screen window, that after that the second and at least the fourth line of the said some raster lines to be scrolled is scrolled from lines in raster scan lines of the screen window and so on until all lines to be scrolled were scrolled into raster scan lines of the window.

2. A system according to claim 1, wherein at least four even-numbered lines are simultaneously scrolled into raster scan lines of said window and after which, four odd-numbered lines are simultaneously scrolled into raster scan lines of said window.

3. A system according to claim 1, wherein within a clock-cycle, two double words of said raster lines to be scrolled of even or odd numbered raster lines are scrolled.

4. A system for scrolling raster scan lines in a window of a personal computer display screen operated in the graphic mode comprising a processor;

a program memory associated with said processor;

a video card having a video RAM memory;

said video RAM memory being displayable on said screen;

an external bus for connecting said video card to said processor;

wherein a first line of said raster scan lines is marked with a destination pointer, after which a scroll is performed and repeated until all lines to be scrolled are in said raster scan lines in said window; wherein simultaneously with said scrolling of said first line of said raster scan lines, at least a third line of said raster scan lines is scrolled in said raster scan lines in said window and at the same time the even-numbered raster lines are blank; after which a second line of said raster scan lines and at least a fourth line of said raster scan lines are filled by being scrolled from lines in said raster scan lines in said window; said scrolling being repeated until all lines to be scrolled are scrolled into raster scan lines in said window and wherein the said scrolling takes place in the video RAM only.

5. Procedure for scrolling successive raster scan lines, namely a first, a second, a third and subsequent raster scan lines, in a window of a screen, operated in the graphic-mode, of a personal computer, which has a processor and a program memory allocated to it including a video card, connected with the processor via an external bus, said video card having a video memory (RAM), whose memory contents can be displayed on the screen, where the first line of the raster scan lines to be scrolled, to be moved in a raster scan line within the window, is marked with a source-pointer and such raster scan line within a window, in which this line is to be moved into, is marked with a destination pointer, subsequently a scroll is performed and repeated until all lines to be scrolled are in the raster scan lines of the window, characterized by the fact that at the same time with the first line there is also at least said third line scrolled in raster scan lines of the screen window, then said second line and at the same time at least a fourth line of the said some raster lines to be scrolled is scrolled in raster scan lines of the screen window until all lines to be scrolled are scrolled into raster scan lines of the window.

* * * * *